US006644795B2

(12) United States Patent
Lin et al.

(10) Patent No.: US 6,644,795 B2
(45) Date of Patent: Nov. 11, 2003

(54) PRESSURE CONTROL DEVICE FOR AN INKJET PEN

(75) Inventors: Sune-Chan Lin, Hsinchu (TW); Charles Chang, Hsinchu (TW); Shyh-Haur Su, Hsinchu (TW); Chun-Jung Chen, Yunlin (TW); Bor-Shiun Lee, Taipei (TW); Chi-Bin Lo, Taipei (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 10/145,724

(22) Filed: May 16, 2002

(65) Prior Publication Data

US 2003/0117469 A1 Jun. 26, 2003

(30) Foreign Application Priority Data

Dec. 25, 2001 (TW) ..... 90222823 U

(51) Int. Cl.[7] ..... B41J 2/175
(52) U.S. Cl. ..... 347/87; 347/86
(58) Field of Search ..... 347/85, 86, 87

(56) References Cited

U.S. PATENT DOCUMENTS 5,719,609 A * 2/1998 Hauck et al. ..... 347/85
5,917,523 A * 6/1999 Baldwin et al. ..... 347/85
5,988,803 A * 11/1999 Komplin et al. ..... 347/86
6,186,620 B1 * 2/2001 Hsieh et al. ..... 347/84
6,213,598 B1 * 4/2001 Hou et al. ..... 347/86

* cited by examiner

*Primary Examiner*—Anh T.N. Vo
(74) *Attorney, Agent, or Firm*—Birch, Stewart, Kolasch & Birch, LLP

(57) ABSTRACT

A pressure control device for an inkjet pen. The inkjet pen is provided with a reservoir having a first opening and maintaining a back pressure established therein. The pressure control device comprises a bag, a pressure plate, an isolation member, a bias member, and an elastic member. The bag, disposed inside the reservoir, communicates with outside the reservoir so as to expand inside the reservoir. The pressure plate is disposed inside the reservoir and adjacent to the bag so as to move inside the reservoir. The bias member is disposed inside the reservoir and adjacent to the pressure plate, the isolation member, and the reservoir respectively such that the bag expands to move the pressure plate when the back pressure inside the reservoir changes, then the pressure plate moves the bias member so that the isolation member separates from the first opening.

38 Claims, 9 Drawing Sheets

PRESSURE CONTROL DEVICE FOR AN INKJET PEN

BACKGROUND OF THE INVENTION

1. Field of the Invention

The invention relates to a pressure control device for an inkjet pen; in particular, a pressure control device that can enhance assembly yield and reduce assembly time.

2. Description of the Related Art

Conventional ink-jet printing generally relies on the controlled delivery of ink droplets from a reservoir of an inkjet pen to a print medium. Among the printing methods for delivering ink drops from the reservoir to the print head, drop-on-demand printing is known as a commonly used method. Drop-on-demand typically uses thermal bubble or piezoelectric pressure wave mechanisms. A thermal bubble type print head includes a thin film resistor that is heated to cause sudden vaporization of a small portion of ink. The vapid expansion of the ink vapor forces a small drop of ink through a print head nozzle. Although drop-on-demand printing is ideal for sending ink drops from a reservoir to the print head, some mechanism must be included to prevent ink leaking out from the print head when the print head is inactive. Such a mechanism usually can build a slight back pressure at the print head to prevent ink leakage from the pen whenever the print head is inactive. Herein, the term "back pressure" represents the partial vacuum within the reservoir. Back pressure is defined in the positive sense so that an increase in back pressure means the degree of partial vacuum has increased.

When the back pressure is established at all times inside the reservoir, ink is prevented from permeating through the print head. However, the back pressure can not be so high that the print head is unable to overcome the back pressure to eject ink drops. Furthermore, as ambient air pressure decreases, a correspondingly greater amount of back pressure is needed to keep ink from leaking. Accordingly, the back pressure within the inkjet pen has to be regulated whenever ambient pressure drops. Also the pressure within the pen is subjected to what may be termed "operational effects", as the depletion of ink from the reservoir increases the back pressure of the reservoir. Without regulation of this back pressure increase, the inkjet pen will fail soon because the back pressure is too high for the print head to overcome it and eject ink drops.

Conventionally, the back pressure within the reservoir is controlled by mechanism referred to as accumulators. In general, an accumulator includes an elastomeric bag capable of moving between a minimum volume position and a maximum volume position in response to changes in the back pressure within the reservoir. For example, as ambient pressure drops so that back pressure within the reservoir decreases simultaneously, the accumulator will move to increase the volume of the reservoir to thereby increase the back pressure to a level that prevent ink leakage. Another example is depletion occurring during operation of the pen. In such a case, accumulators will move to decrease the volume of the reservoir to reduce the back pressure to a level within operating range, thereby permitting the print head to continue ejecting ink.

However, although accumulators such as elastomeric bags can automatically adjust the volume of the reservoir to keep the back pressure within the operating range, the extent to which elastomeric bags are capable of expanding is quite limited. Consequently, when ink level gradually drops from the print head, the bag may reach its maximum extent and therefore incapable of any further adjustment of the volume of the reservoir. Hence, the back pressure within the reservoir may increase such that ink droplets are prevented from leaving the print head.

To resolve the aforementioned problems, some inkjet pens employ a device called a "bubble generator". The bubble generator has an orifice through which ambient air can enter the reservoir. The dimension of the orifice is such that ink is trapped within the orifice to seal off the reservoir by capillary effect. When ambient air pressure is high enough to overcome the liquid seal, air can bubble into the reservoir. Therefore, the back pressure within the reservoir can decrease and capillary effect will take over and re-establish the liquid seal again to prevent entrance of more air bubbles.

In general, bubble generators of inkjet pens must satisfy a few conditions. Firstly, the bubble generator must be able to control back pressure precisely. Secondly, the range of fluctuation of the back pressure within the reservoir must be as small as possible. In other words, as air bubbles enter the reservoir leading to a drop in back pressure, the bubble generator must be able to stop the entrance of bubbles soon enough that a suitable back pressure remains inside. Thirdly, the bubble generator must have self-wetting capability. The liquid seal must be able to prevent the entrance of bubbles even when most of the ink within the reservoir is used up, or alternately when the inkjet pen is tilted so much that the bubble generator is no longer immersed below the ink.

Referring to FIG. 1 and FIG. 2, a conventional bubble generator 118 according to U.S. Pat. No. 5,526,030 is shown. The bubble generator 118 installed within the reservoir 102 has an orifice 122 and a sphere 124. FIG. 2 is a top view showing the surrounding structure of the bubble generator 118. As shown in FIG. 2, the internal side-walls of the orifice 122 contain equidistantly spaced protruding ribs 126, 128 for centering the sphere 124. The circular gap 120 between the sphere 124 and the orifice 122 is located where ambient bubbles are produced. Normally, a bubble generator 118 as above is able to meet the demands required for printing with an inkjet pen. In general, the entrance of bubbles into the inkjet pen is determined by surface tension of the ink itself, static pressure of the ink column and the gap 120 between the sphere 124 and the orifice 122, as shown in FIG. 3. Usually, the greater the surface tension of the ink or smaller the gap between the sphere 124 and the orifice 122, the higher will be the back pressure required within the reservoir 102 before air bubbles will start to enter. In addition, the static pressure of the ink column within the reservoir 102 can affect the value of back pressure required before air bubbles begin to enter the reservoir. Therefore, as ink level gradually drops, static pressure of the ink column will decrease leading to the entrance of air bubbles at a smaller back pressure. In summary, major drawbacks of the aforementioned pressure control technique includes:

1. The value of back pressure within the reservoir before the bubble generator starts to function is related to surface tension of the ink used. Since various inks may have different surface tension, the minimum back pressure under which air bubbles can enter the reservoir may be different for each type of ink. Consequently, the gap between the sphere and the orifice must be designed for various inks.

2. The value of back pressure within the reservoir before bubble generator starts to function is also related to the static pressure generated by the column of ink. As ink level within the reservoir drops gradually, static pressure acting on the bubble generator will drop making it easier for air bubbles to enter the reservoir. Often this will lead to a lowering of back pressure within the reservoir, and the adjustable range of the accumulator will be reduced.

3. The gap between the sphere and the orifice has to be precisely engineered to permit the entrance of air bubbles at the correct back pressure within the reservoir. This will increase difficulties in fabricating the reservoir of an ink-jet pen.

FIG. 4 shows another conventional pressure control device 410 for an inkjet pen according to U.S. Pat. No. 6,213,598. During the assembly, a flat spring 330 is welded to the bottom of an inkjet pen 400 so that the flat spring 330 presses a sphere 320 of a bubble generator. Since the flat spring 330 is located at the bottom of the inkjet pen, it is difficult to dispose the flat spring 330 at a predetermined position during the assembly. In addition, an expandable bag 416 is in contact with a pressure plate 412, and the pressure plate 412 is supported by a spring 414. The arrangement between the pressure plate 412, the spring 414, and the bag 416 is unreliable, and the assembly between them is laborious.

In light of the foregoing, there is a need to provide a better pressure control device within a reservoir.

SUMMARY OF THE INVENTION

In order to address the disadvantages of the aforementioned pressure control device for inkjet pen, the invention provides a pressure control device that can enhance assembly yield and reduce assembly time.

Another purpose of this invention is to provide an inkjet pen with a stable pressure control device.

Accordingly, the invention provides a pressure control device for a reservoir having a first opening and maintaining back pressure established therein. The pressure control device comprises a bag, a pressure plate, an isolation member, a bias member, and an elastic member. The bag, disposed inside the reservoir, communicates with outside the reservoir so as to expand inside the reservoir. The pressure plate is disposed inside the reservoir and adjacent to the bag so as to move inside the reservoir. The isolation member, disposed inside the reservoir in a moveable manner, seals the first opening. The bias member is disposed inside the reservoir and adjacent to the pressure plate, the isolation member, and the reservoir respectively so as to move inside the reservoir. The bias member adjusts the isolation member to seal the first opening based on the movement of the pressure plate. The elastic member, disposed inside the reservoir and adjacent to the pressure plate and the bias member respectively, restrains the expansion of the bag. Thus, the bag expands to move the pressure plate when the back pressure inside the reservoir changes, then the pressure plate moves the bias member so that the isolation member separates from the first opening.

In a preferred embodiment, the reservoir is provided with a second opening, and the bag is provided with a third opening communicating with the second opening.

In another preferred embodiment, the isolation member is a sphere.

In another preferred embodiment, the bias member is provided with an extension plate, adjacent to the reservoir, for the convenience of the assembly of the bias member.

Furthermore, the extension plate is provided with at least one support for fixing the elastic member, and the extension plate is fixed on the reservoir.

In another preferred embodiment, the bias member is a flat spring.

In another preferred embodiment, the elastic member is a spring.

In another preferred embodiment, the outside of the reservoir refers to the atmosphere.

In another preferred embodiment, the bias member and the elastic member are made of stainless steel.

In another preferred embodiment, the bias member and the elastic member are integrally formed.

Furthermore, the reservoir is provided with at least one post, and the integrally formed bias and elastic member is provided with at least one first through hole. Thus, the integrally formed bias and elastic member is fixedly disposed inside the reservoir by inserting the post through the first through hole.

Furthermore, the post is fixed inside the first through hole by welding.

Furthermore, the reservoir is provided with a rib for fixing the integrally formed bias and elastic member.

Furthermore, the integrally formed bias and elastic member is provided with at least one second through hole for adjusting the elastic coefficient of the integrally formed bias and elastic member.

In another embodiment, the invention provides an inkjet pen. The inkjet pen comprises a reservoir, a bag, a pressure plate, an isolation member, a bias member, and an elastic member The reservoir has a first opening and maintains a back pressure established therein. The bag, disposed inside the reservoir, communicates with outside the reservoir so as to expand inside the reservoir. The pressure plate is disposed inside the reservoir and adjacent to the bag so as to move inside the reservoir. The isolation member, disposed inside the reservoir in a moveable manner, seals the first opening. The bias member is disposed inside the reservoir and adjacent to the pressure plate, the isolation member, and the reservoir respectively so as to move inside the reservoir. The bias member adjusts the isolation member to seal the first opening based on the movement of the pressure plate. The elastic member, disposed inside the reservoir and adjacent to the pressure plate and the bias member respectively, restrains the expansion of the bag. Thus, the bag expands to move the pressure plate when the back pressure inside the reservoir changes, then the pressure plate moves the bias member so that the isolation member separates from the first opening.

BRIEF DESCRIPTION OF THE DRAWINGS

The invention is hereinafter described in detail with reference to the accompanying drawings in which.

DETAILED DESCRIPTION OF THE INVENTION

First Embodiment

Figure 1:
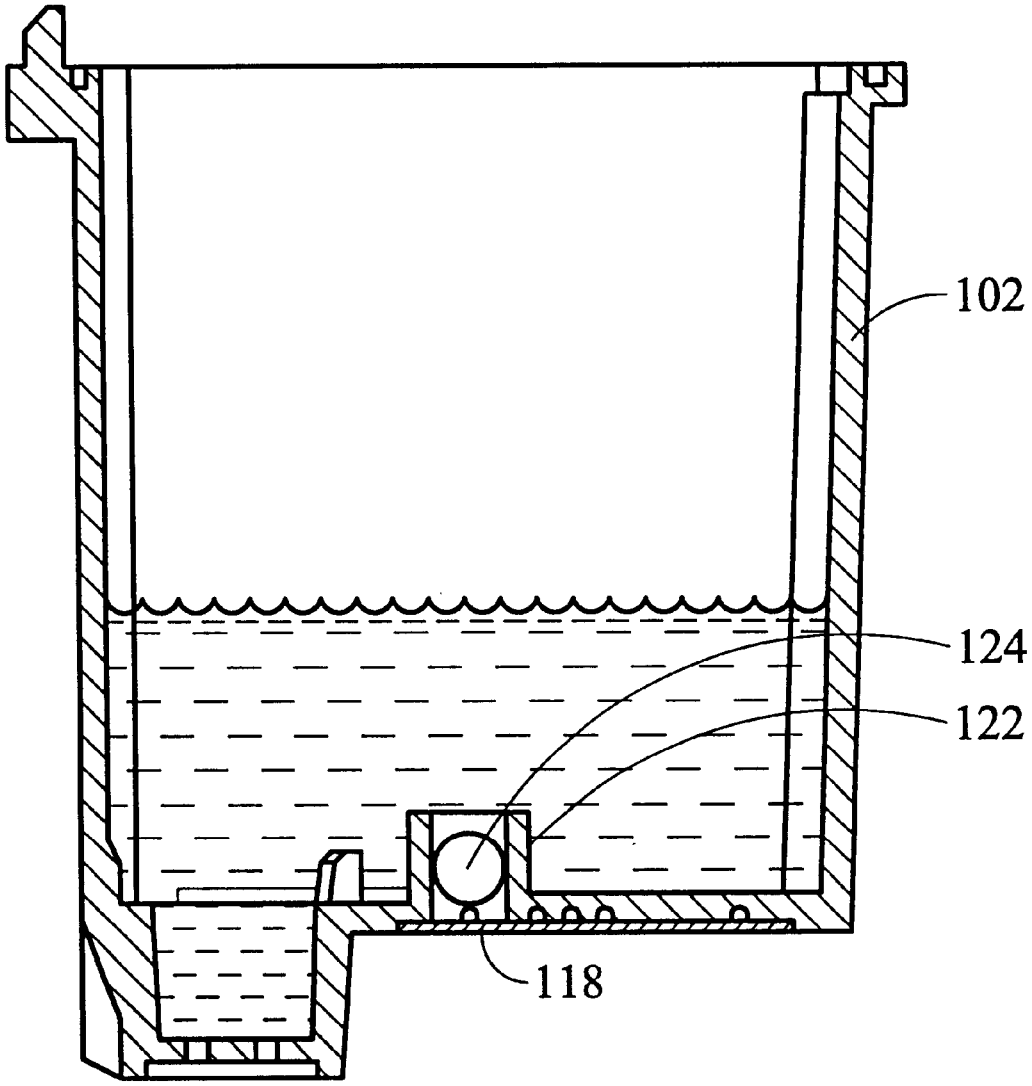
FIG. 1 (PRIOR ART)
FIG. 1, FIG. 2, and FIG. 3 are schematic views of a conventional bubble generator according to U.S. Pat. No. 5,526,030.
Figure 2:
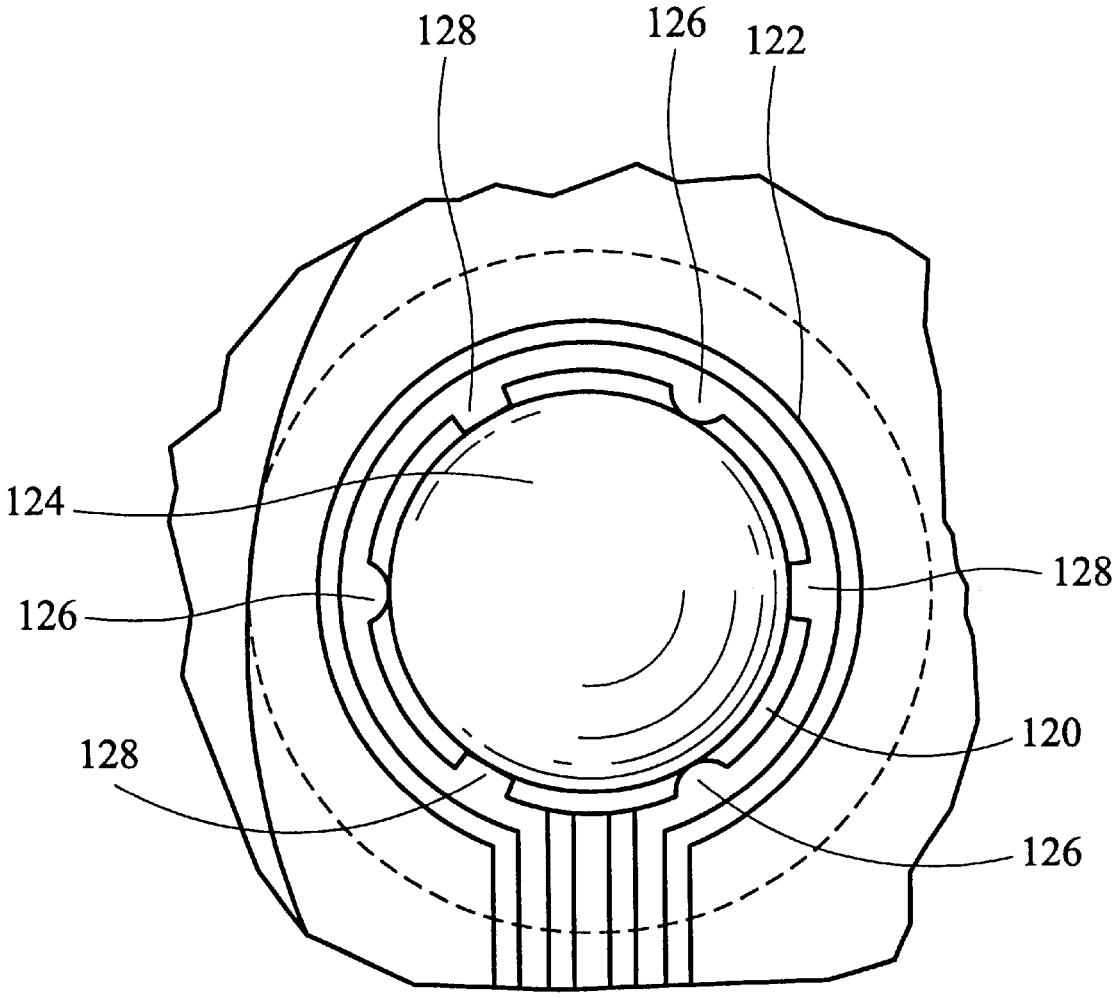
FIG. 2 (PRIOR ART)
Figure 3:
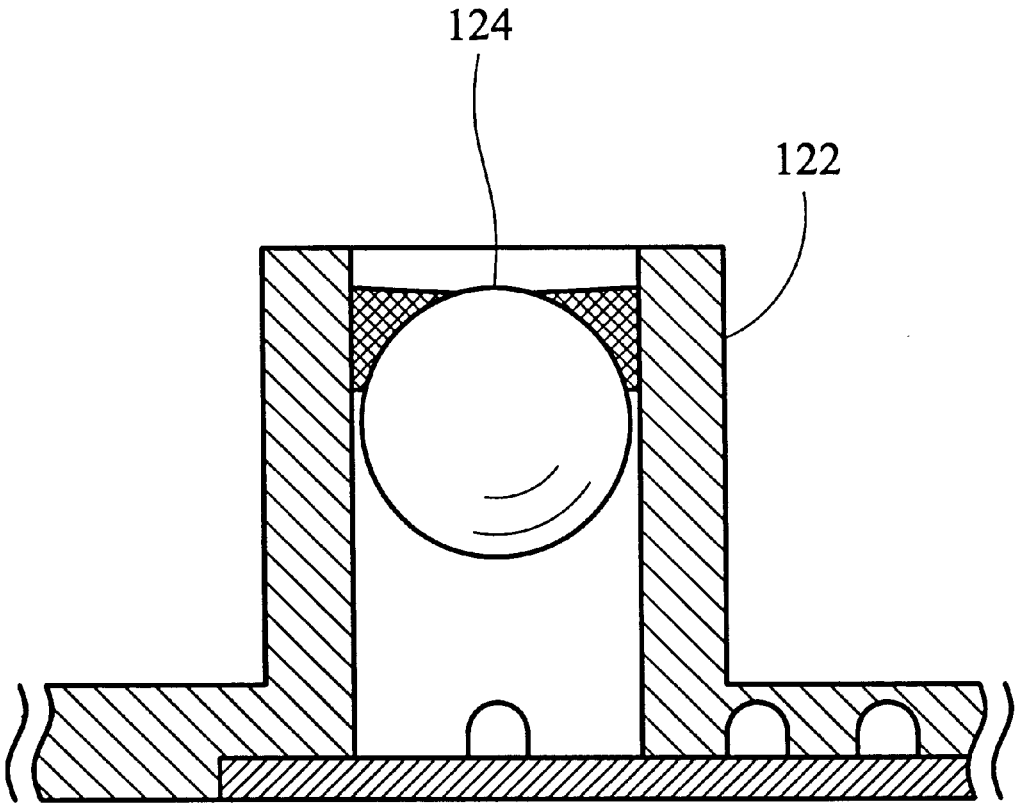
FIG. 3 (PRIOR ART)
Figure 4:
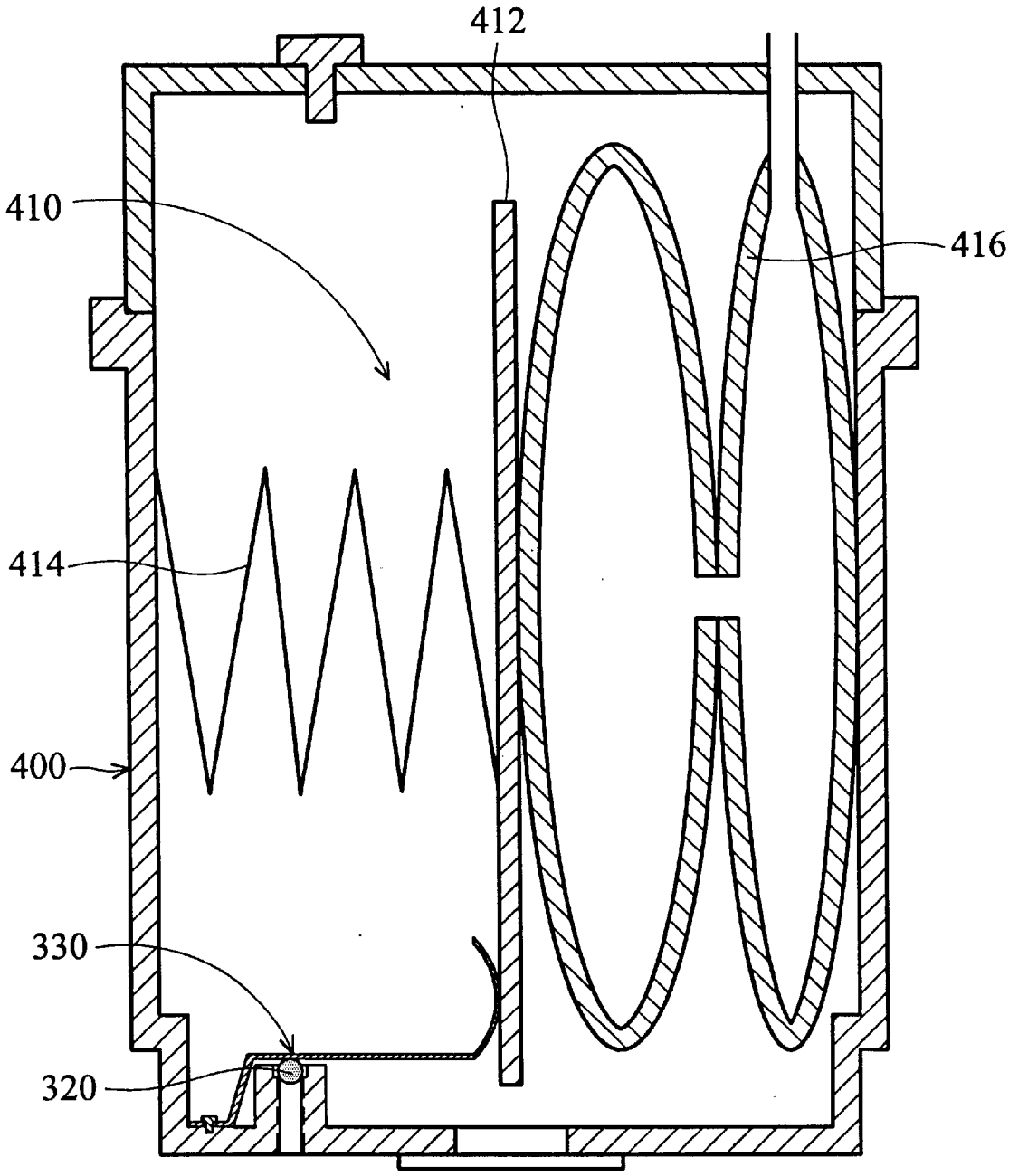
FIG. 4 (PRIOR ART)
FIG. 4 is a schematic view of a conventional pressure control device according to U.S. Pat. No. 6,213,598.
Figure 5A:
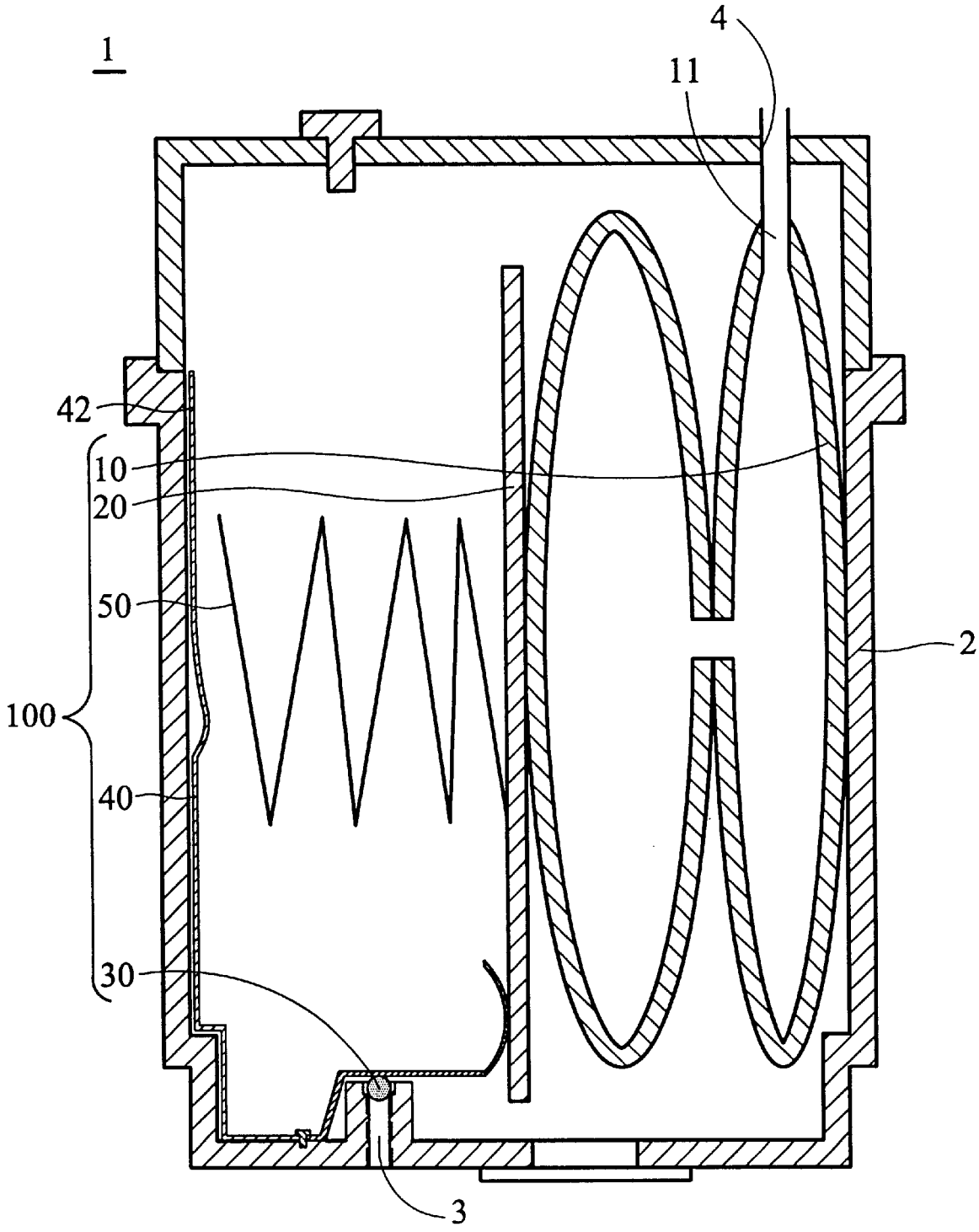
FIG. 5*a* is a schematic view that shows an inkjet pen as disclosed in a first embodiment of this invention.

As shown in FIG. 5*a*, an inkjet pen 1, as disclosed in a first embodiment of this invention, comprises a reservoir 2, a bag 10, a pressure plate 20, an isolation member 30, a bias member 40, and an elastic member 50. The bag 10, the pressure plate 20, the isolation member 30, the bias member 40, and the elastic member 50 constitute of a pressure control device 100 of the first embodiment of this invention.

The reservoir 2 is provided with a first opening 3 and a second opening 4, and maintains a back pressure established therein. The reservoir 2 communicates with the atmosphere through the first opening 3 and the second opening 4.

The bag 10 is disposed inside the reservoir 2, and is provided with a third opening 11 communicating with the second opening 4 of the reservoir 2. The bag 10 communicates with outside the reservoir 2 through the third opening 11 so as to expand inside the reservoir 2. It is noted that the outside of the reservoir 2 refers to the atmosphere.

The pressure plate 20 is disposed inside the reservoir 2 and adjacent to the bag 10 so as to move inside the reservoir 2. It is noted that the air from the atmosphere enters into the bag 10 through the third opening 11 to expand the bag 10 when the back pressure of the reservoir 2 increases.

The isolation member 30, disposed inside the reservoir 2 in a moveable manner, seals the first opening 3 of the reservoir 2. The isolation member 30 may be a sphere.

Figure 5B:
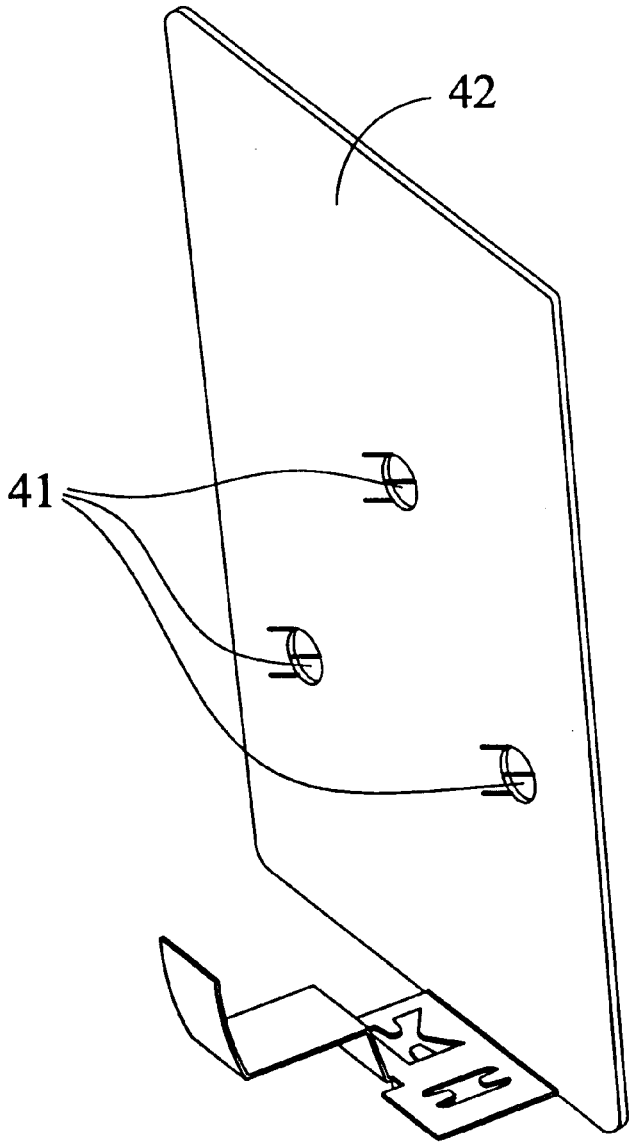
FIG. 5*b* is a schematic view that shows a bias member in FIG. 5*a;*

The bias member 40 is disposed inside the reservoir 2 and adjacent to the pressure plate 20, the isolation member 30, and the reservoir 2 respectively so as to move inside the reservoir 2. The bias member 40 adjusts the isolation member 30 to seal the first opening 3 of the reservoir 2 based on the movement of the pressure plate 20. The bias member 40 is provided with an extension plate 42 at one end. The extension plate 42 is disposed inside the reservoir 2 so as to be adjacent to the reservoir 2, and used for the convenience of the assembly of the bias member 40. The other end, opposite to the extension plate 42, of the bias member 40 is adjacent to the pressure plate 20. The position that the bias member 40 is in contact with the isolation member 30 is located between the extension plate 42 and the other end of the bias member 40. As shown in FIG. 5*b*, the extension plate 42 is provided with three supports 41 for fixing the elastic member 50. The bias member 40 may be a flat spring. It is noted that the elastic coefficient of the bias member 40 is very important. When the value of the elastic coefficient of the bias member 40 is too high, the pressure plate 20 cannot press the bias member 40 to separate from the sphere 30 even if the pressure plate 20 is in contact with the bias member 40. As a result, the air cannot enter into the reservoir 2.

The elastic member 50, disposed inside the reservoir 2 and adjacent to the pressure plate 20 and the bias member 40 respectively, restrains the expansion of the bag 10. Thus, the bag 10 expands to move the pressure plate 20 when the back pressure inside the reservoir 2 changes, then the pressure plate 20 moves the bias member 40 so that the isolation member 30 separates from the first opening 3 of the reservoir 2. The elastic member 50 may be a spring. It is noted that the elastic member 50 is a key part to control and balance the back pressure inside the reservoir 2. The back pressure inside the reservoir 2 increase when the elastic force of the elastic member 50 is too strong, and the back pressure inside the reservoir 2 decrease when the elastic force of the elastic member 50 is too weak. Thus, the elastic force of the elastic member 50 affects the printing quality of the inkjet pen 1.

Furthermore, the bias member 40 and the elastic member 50 are made of stainless steel.

When the ink-jet pen 1 is used for printing, the air pressure within the reservoir 2 decreases as ink is depleted. Hence, the back pressure inside the reservoir 2 increases. During printing, the bag 10 will then expand. As the bag 10 expands, it will push on the pressure plate 20 and compress the elastic member 50 thereby reducing the volume of the reservoir 2 to maintain the back pressure of the reservoir 2 within a adequate level such that the inkjet pen 1 is able to continue ejecting ink from the reservoir 2. When ambient air pressure decreases, for example, during air transportation of the inkjet pen 1, the elastic member 50 will push the pressure plate 20 against the bag 10 so that the bag 10 will contract due to a lower ambient pressure. The contraction of the bag 10 will increase the volume of the reservoir 2 so that the back pressure within the reservoir 2, relative to ambient, does not drop to a level that permits ink to leak from the inkjet pen 1.

As the bag 10 expands to its largest possible expandable volume, the volume of the reservoir 2 can not change further. From this moment on, if the inkjet pen 1 continues to eject ink, the back pressure within the reservoir 2 will increase to a level that the inkjet pen 1 will no longer be able to overcome the back pressure such that the inkjet pen 1 stops ejecting ink. Therefore, it is the object of the invention to provide a device for regulating the pressure in an inkjet pen 1 that minimizes the amount of unusable ink discarded with an inkjet pen 1 that stops printing because the back pressure exceeded the operating range.

As bag 10 continues to expand, the pressure plate 20 will be pushed toward the extension plate 42. The lower portion of the pressure plate 20 is in contact with the other end of the bias member 40. Due to compression by the pressure plate 20, the portion, contacting the isolation member 30, of the bias member 40 will be lifted up such that the bias member 40 and the isolation member 30 are separated. When the bias member 40 is no longer pressing on the isolation member 30, the back pressure within the reservoir 2 will raise the isolation member 30 briefly to not seal the first opening 3. Consequently, the back pressure overcomes the capillary forces of the ink so that ambient air bubbles into the reservoir 2 to reduce the back pressure.

As ambient air is bubbled into the reservoir 2, the back pressure within the reservoir 2 will decrease, thus the bag 10 will move in a direction opposite to the extension plate 42 due to the compression of the elastic member 50. At this moment, the bias member 40 is no longer pushed by the pressure plate 20. Under its restorative force, the bias member 40 moves back, and is again pressing on the isolation member 40 to seal off the first opening 3. Once the first opening 3 is re-sealed, air can no longer enter the reservoir 2.

Since the bias member 40 is provided with an extension plate 42, it is more convenient to assemble the bias member 40 inside the reservoir 2. Specifically, in the prior art, the bias member is individually welded to the reservoir so that it is difficult to assemble the bias member inside the reservoir. By contrast, because of the extension plate, the bias member can be assembled inside the reservoir along with the elastic member and the pressure plate. Thus, the assembly process is reduced. In addition, due to the extension plate, the bias member can be stably disposed inside the reservoir.

Furthermore, compared with the prior art, the assembly time of this invention is largely reduced.

Second Embodiment

Figure 6A:
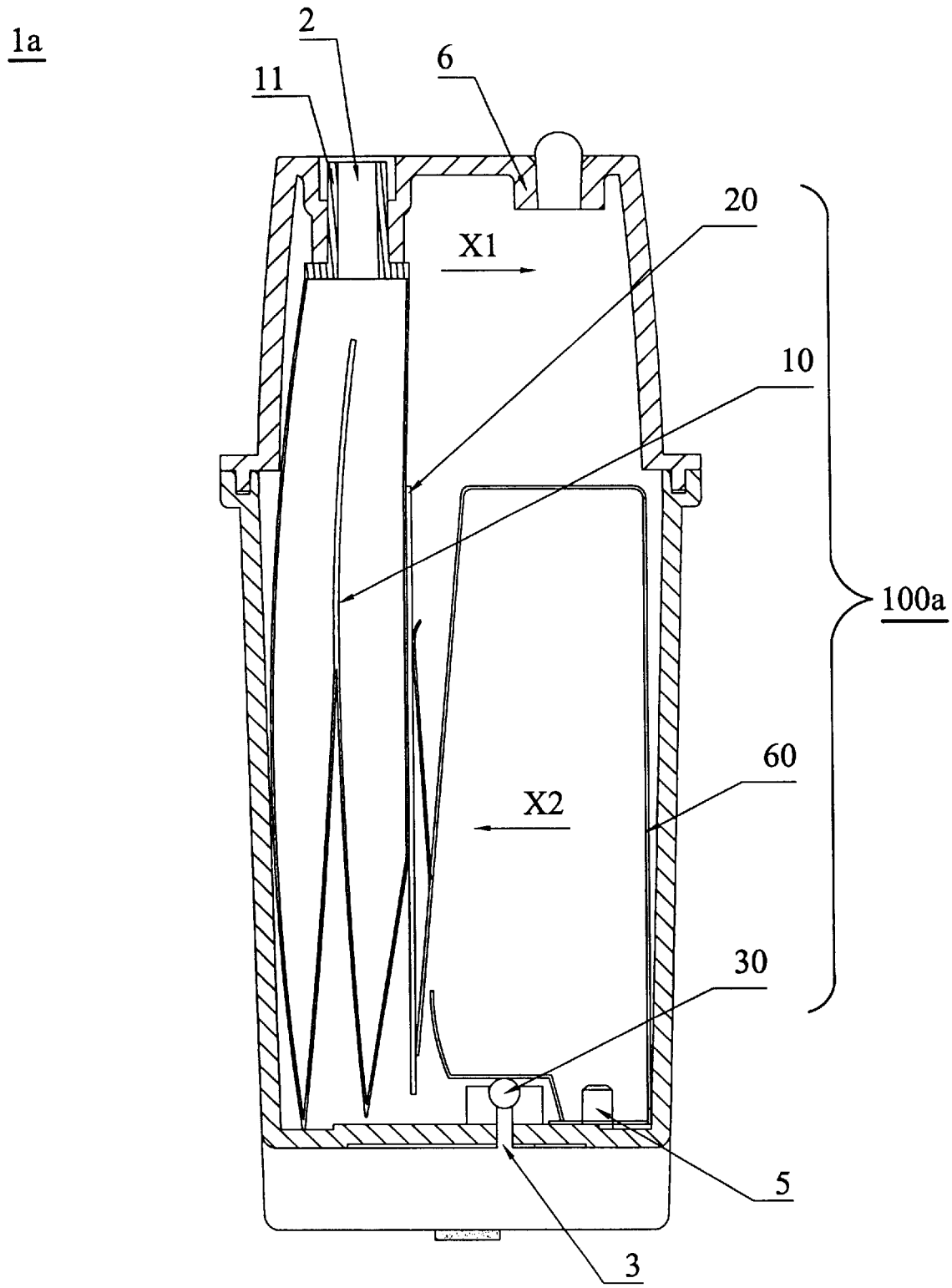
FIG. 6*a* and FIG. 6*b* are schematic views that shows an inkjet pen as disclosed in a second embodiment of this invention.
Figure 6B:
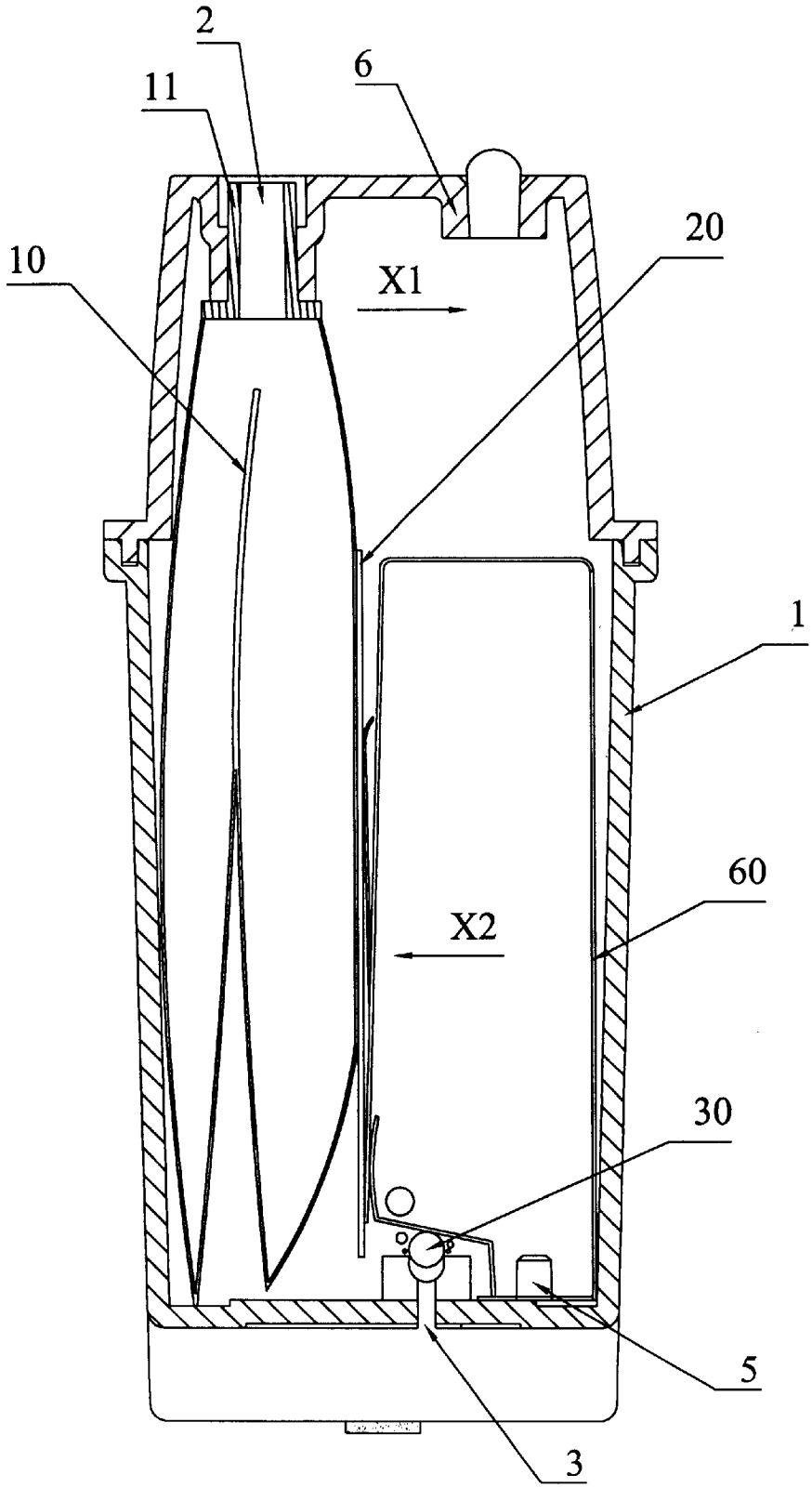

As shown in FIG. 6*a* and FIG. 6*b*, an inkjet pen 1*a*, as disclosed in a second embodiment of this invention, comprises a reservoir 2, a bag 10, a pressure plate 20, an isolation member 30, an integrally formed bias and elastic member 60. The bag 10, the pressure plate 20, the isolation member 30, the integrally formed bias and elastic member 60 constitute a pressure control device 100*a* of the second embodiment of this invention.

The difference between this embodiment and the first embodiment is that the bias member 40 and the elastic member 50 of the first embodiment are integrally formed into the integrally formed bias and elastic member 60 in this embodiment.

Figure 7A:
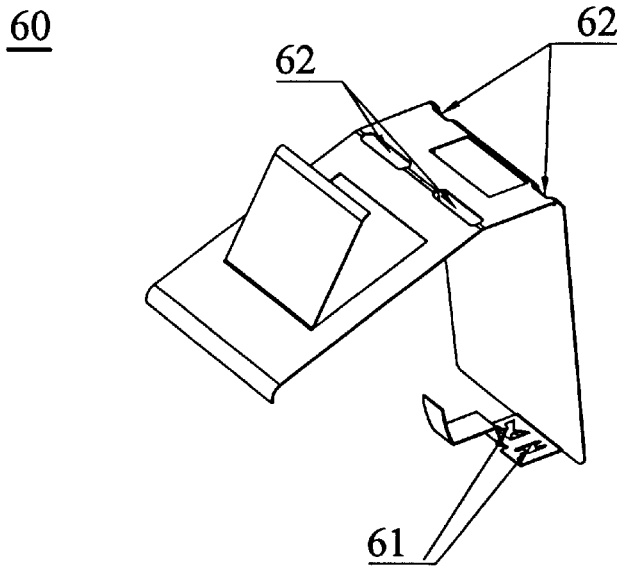
FIG. 7*a* is a schematic view that shows an integrally formed bias and elastic member in FIG. 6*a*.

Furthermore, referring to FIG. 7*a*, the integrally formed bias and elastic member 60 is provided with two first through holes 61 and a plurality of second through holes 62. The second through holes 62 are used for adjusting the elastic coefficient of the integrally formed bias and elastic member 60.

Figure 7B:
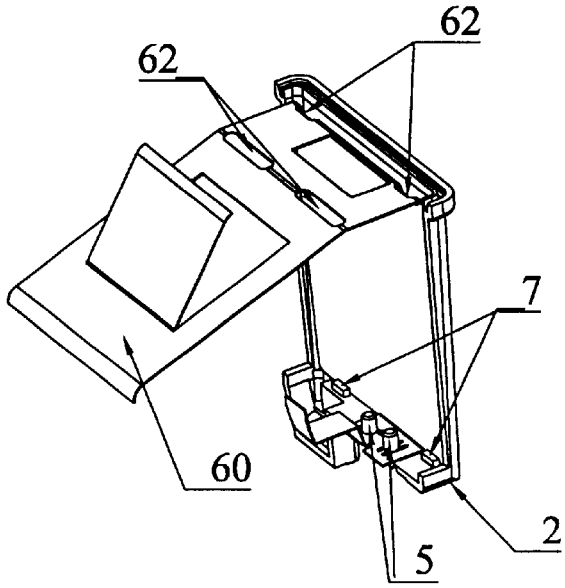
FIG. 7*b* is a schematic view that shows the integrally formed bias and elastic member in FIG. 7*a* fixed inside a reservoir.

Referring to FIG. 7*b*, the reservoir 2 is provided with two posts 5. Thus, the integrally formed bias and elastic member 60 is fixedly disposed inside the reservoir 2 by inserting the posts 5 through the first through holes 61. It is noted that the posts 5 may be fixed inside the first through holes 61 by welding.

In addition, referring to FIG. 7*b*, the reservoir 2 is provided with two ribs 7 for fixing the integrally formed bias and elastic member 60.

It is understood that the ink enters into the reservoir 2 through a fourth opening 6 as shown in FIG. 6*a*.

As the ink is depleted and the bag 10 continues to expand, the pressure plate 20 will be pushed in a Direction X1 as shown in FIG. 6*a*. The lower portion of the pressure plate 20 is in contact with the integrally formed bias and elastic member 60. Due to compression by the pressure plate 20, the portion, contacting the isolation member 30, of the integrally formed bias and elastic member 60 will be lifted up such that the integrally formed bias and elastic member 60 and the isolation member 30 are separated. When the integrally formed bias and elastic member 60 no longer presses on the isolation member 30, the back pressure within the reservoir 2 will raise the isolation member 30 briefly to not seal the first opening 3. Consequently, the back pressure overcomes the capillary forces of the ink so that ambient air is bubbling into the reservoir 2 to reduce the back pressure.

As ambient air is bubbled into the reservoir 2, the back pressure within the reservoir 2 will decrease, thus the bag 10 will move in a direction X2 as shown in FIG. 6*b* due to the compression of the integrally formed bias and elastic member 60. At this moment, the integrally formed bias and elastic member 60 is no longer pushed by the pressure plate 20. Under its restorative force, the integrally formed bias and elastic member 60 moves back, and is again pressing on the isolation member 30 to seal off the first opening 3. Once the first opening 3 is re-sealed, air can no longer enter the reservoir 2.

Since the integrally formed bias and elastic member 60 is a single element, assembly is easier and assembly time is largely reduced. In addition, by means of the integrally formed bias and elastic member 60, the back pressure inside the reservoir 2 can be properly maintained. Thus, the ink inside the inkjet pen 1*a* can be prevented from permeating while the inkjet pen 1*a* can normally process printing.

While the invention has been particularly shown and described with reference to a preferred embodiment, it will be readily appreciated by those of ordinary skill in the art that various changes and modifications may be made without departing from the spirit and scope of the invention. It is intended that the claims be interpreted to cover the disclosed embodiment, those alternatives which have been discussed above, and all equivalents thereto.

What is claimed is:

1. A pressure control device for a reservoir, having a first opening and maintaining a back pressure established therein, comprising:

a bag, disposed inside the reservoir, communicating with outside the reservoir so as to expand inside the reservoir;

a pressure plate disposed inside the reservoir and adjacent to the bag so as to move inside the reservoir;

an isolation member, disposed inside the reservoir in a moveable manner, for sealing the first opening;

a bias member disposed inside the reservoir and adjacent to the pressure plate, the isolation member, and the reservoir respectively so as to move inside the reservoir, wherein the bias member adjusts the isolation member to seal the first opening based on the movement of the pressure plate; and an elastic member, disposed inside the reservoir and adjacent to the pressure plate and the bias member respectively, for restraining the expansion of the bag, whereby the bag expands to move the pressure plate when the back pressure inside the reservoir changes, then the pressure plate moves the bias member so that the isolation member separates from the first opening.

2. The pressure control device as claimed in claim 1, wherein the reservoir is provided with a second opening, and the bag is provided with a third opening communicating with the second opening.

3. The pressure control device as claimed in claim 1, wherein the isolation member is a sphere.

4. The pressure control device as claimed in claim 1, wherein the bias member is provided with an extension plate, adjacent to the reservoir, for the convenience of the assembly of the bias member.

5. The pressure control device as claimed in claim 4, wherein the extension plate is provided with at least one support for fixing the elastic member.

6. The pressure control device as claimed in claim 4, wherein the extension plate is fixed on the reservoir.

7. The pressure control device as claimed in claim 1, wherein the bias member is a flat spring.

8. The pressure control device as claimed in claim 1, wherein the elastic member is a spring.

9. The pressure control device as claimed in claim 1, wherein the outside of the reservoir refers to the atmosphere.

10. The pressure control device as claimed in claim 1, wherein the bias member and the elastic member are made of stainless steel.

11. The pressure control device as claimed in claim 1, wherein the bias member and the elastic member are integrally formed.

12. The pressure control device as claimed in claim 11, wherein the reservoir is provided with a second opening, and the bag is provided with a third opening communicating with the second opening.

13. The pressure control device as claimed in claim 11, wherein the isolation member is a sphere.

14. The pressure control device as claimed in claim 11, wherein the outside of the reservoir refers to the atmosphere.

15. The pressure control device as claimed in claim 11, wherein the integrally formed bias and elastic member is made of stainless steel.

16. The pressure control device as claimed in claim 11, wherein the reservoir is provided with at least one post, and the integrally formed bias and elastic member is provided with at least one first through hole, whereby the integrally formed bias and elastic member is fixedly disposed inside the reservoir by inserting the post through the first through hole.

17. The pressure control device as claimed in claim 16, wherein the post is fixed inside the first through hole by welding.

18. The pressure control device as claimed in claim 11, wherein the reservoir is provided with at least one rib for fixing the integrally formed bias and elastic member.

19. The pressure control device as claimed in claim 11, wherein the integrally formed bias and elastic member is provided with at least one second through hole for adjusting the elastic coefficient of the integrally formed bias and elastic member.

20. An inkjet pen comprising:

a reservoir having a first opening and maintaining a back pressure established therein;

a bag, disposed inside the reservoir, communicating with outside the reservoir so as to expand inside the reservoir;

a pressure plate disposed inside the reservoir and adjacent to the bag so as to move inside the reservoir;

an isolation member, disposed inside the reservoir in a moveable manner, for sealing the first opening;

a bias member disposed inside the reservoir and adjacent to the pressure plate, the isolation member, and the reservoir respectively so as to move inside the reservoir, wherein the bias member adjusts the isolation member to seal the first opening based on the movement of the pressure plate; and an elastic member, disposed inside the reservoir and adjacent to the pressure plate and the bias member respectively, for restraining the expansion of the bag, whereby the bag expands to move the pressure plate when the back pressure inside the reservoir changes, then the pressure plate moves the bias member so that the isolation member separates from the first opening.

21. The inkjet pen as claimed in claim 20, wherein the reservoir is provided with a second opening, and the bag is provided with a third opening communicating with the second opening.

22. The inkjet pen as claimed in claim 20, wherein the isolation member is a sphere.

23. The inkjet pen as claimed in claim 20, wherein the bias member is provided with an extension plate, adjacent to the reservoir, for the convenience of the assembly of the bias member.

24. The inkjet pen as claimed in claim 23, wherein the extension plate is provided with at least one support for fixing the elastic member.

25. The inkjet pen as claimed in claim 23, wherein the extension plate is fixed on the reservoir.

26. The inkjet pen as claimed in claim 20, wherein the bias member is a flat spring.

27. The inkjet pen as claimed in claim 20, wherein the elastic member is a spring.

28. The inkjet pen as claimed in claim 20, wherein the outside of the reservoir refers to the atmosphere.

29. The inkjet pen as claimed in claim 20, wherein the bias member and the elastic member are made of stainless steel.

30. The inkjet pen as claimed in claim 20, wherein the bias member and the elastic member are integrally formed.

31. The inkjet pen as claimed in claim 30, wherein the reservoir is provided with a second opening, and the bag is provided with a third opening communicating with the second opening.

32. The inkjet pen as claimed in claim 30, wherein the isolation member is a sphere.

33. The inkjet pen as claimed in claim 30, wherein the outside of the reservoir refers to the atmosphere.

34. The inkjet pen as claimed in claim 30, wherein the integrally formed bias and elastic member is stainless steel.

35. The inkjet pen as claimed in claim 30, wherein the reservoir is provided with at least one post, and the integrally formed bias and elastic member is provided with at least one first through hole, whereby the integrally formed bias and elastic member is fixedly disposed inside the reservoir by inserting the post through the first through hole.

36. The inkjet pen as claimed in claim 35, wherein the post is fixed inside the first through hole by welding.

37. The inkjet pen as claimed in claim 30, wherein the reservoir is provided with at least one rib for fixing the integrally formed bias and elastic member.

38. The inkjet pen as claimed in claim 30, wherein the integrally formed bias and elastic member is provided with at least one second through hole for adjusting the elastic coefficient of the integrally formed bias and elastic member.

* * * * *